United States Patent [19]

Albertassi et al.

[11] 4,131,959

[45] Jan. 2, 1979

[54] NON-POLLUTING TOILET SYSTEM

[75] Inventors: James H. Albertassi, W. Falmouth, Mass.; Walter O. Heinze, Swarthmore, Pa.

[73] Assignee: International Water Saving Systems, Inc., New York, N.Y.

[21] Appl. No.: 803,071

[22] Filed: Jun. 3, 1977

[51] Int. Cl.[2] ..... E03D 9/10; E03D 11/11

[52] U.S. Cl. ..... 4/319; 4/320; 4/420; 4/431; 4/432; 4/433

[58] Field of Search ..... 4/10, 89, 90, 77, 115, 4/1, 86, 320, 420, 431, 432, 433, 319; 210/152, 60, 62

[56] References Cited

U.S. PATENT DOCUMENTS

| | | | |
|---|---|---|---|
| 3,478,690 | 11/1969 | Helke et al. | 4/90 |
| 3,520,003 | 7/1970 | Shaw | 4/77 |
| 3,550,163 | 12/1970 | Jong | 4/77 |
| 3,593,346 | 7/1971 | Katona | 4/90 |

*Primary Examiner*—Henry K. Artis

*Attorney, Agent, or Firm*—Dike, Bronstein, Roberts, Cushman & Pfund

[57] ABSTRACT

A toilet system capable of rendering the effluent innocuous and reducing the solid matter therein to microparticle size comprising a reversible, motor-driven pump and a two-position valve operable, on the one hand, for taking water into the system for flushing effluent from the bowl into a treating chamber and, on the other hand, to empty the treating chamber and discharge the effluent from the system so that both the pump and the valve are self-purging. There is a two-position switch for reversing the motor-driven pump and a valve rod for moving the two-position valve from one position to the other. A motor-driven macerator in the treating chamber provides for effecting maceration of the effluent flushed into the treating chamber. A bacteriacide may be employed to render the effluent innocuous. The macerator is operable independently of the motor-driven pump so that the system can be purged without simultaneous operation of the macerator.

20 Claims, 10 Drawing Figures

NON-POLLUTING TOILET SYSTEM

BACKGROUND OF INVENTION

There is need for a nonpolluting toilet system for marine use, recreational vehicles, mobile homes, vacation homes construction sites, trains, planes and the like, regardless of whether or not sewer facilities are available. Chemical and incinerator-type toilet systems have been developed to meet the aforesaid means. However, such systems as have been developed have in common been unable to meet the good health and sanitary requirements and/or the federal standards with respect to decontamination and/or reduction in particle size or have not been sufficiently nonpolluting as far as disease-causing bacteria are concerned; and have required extensive plumbing, holding tanks, pumps, valves and the like which are difficult to keep sufficiently clean to eliminate odor and which form a harbor for the development of bacteria. The objective sought herein was to design a system which would reduce the bacteria to zero or virtually zero coliform bacteria count and to reduce the solid content to microparticle size below any presently available system. Also, a system so designed as to simplify the plumbing, provide pump and valve components which are self-purging so as to eliminate the last vestige of odor and bacterial contamination, and the unpleasant duty of having to disassemble pumps, valves and the like in the system for cleaning.

SUMMARY OF INVENTION

As herein illustrated, the toilet system comprises a bowl, a reversible motor-driven pump operable in one direction to supply flush water to the bowl to flush the same, a single treating chamber for receiving effluent flushed from the bowl, means for supplying a bacteriacide to the treating chamber and a macerator in the treating chamber for reducing the solid content to microparticle size. The maceration is effected in isolation from any other fluid. Valve means operable in one position to cause the pump to effect flushing of the effluent from the bowl into the treating chamber and in the other position to discharge the treated effluent from the chamber provides for purging the system. There is a control circuit including switch means for reversing the motor-driven pump, switch means for initiating operation of the macerator motor, a timer for terminating operation of the macerator motor and manually or electrically-operable means for shifting the position of the valve. The treating chamber is of a predetermined capacity such as to receive a predetermined volume of effluent for treatment and the pump is designed to discharge the entire amount of the treated effluent from the treating chamber and terminate the macerating cycle.

The invention will now be described in greater detail with reference to the accompanying drawings, wherein.

Figure 6:
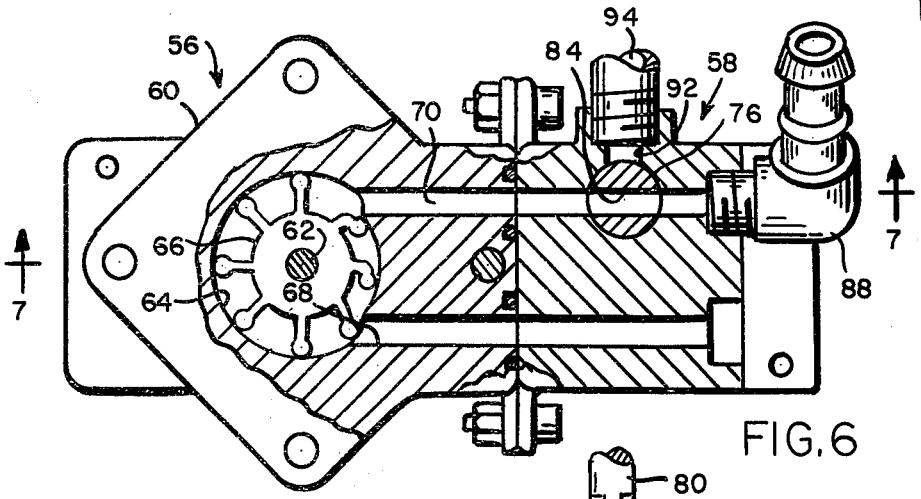
FIG. 6 is a plan view partly in section of the motor-driven pump and valve assembly.
Figure 7:
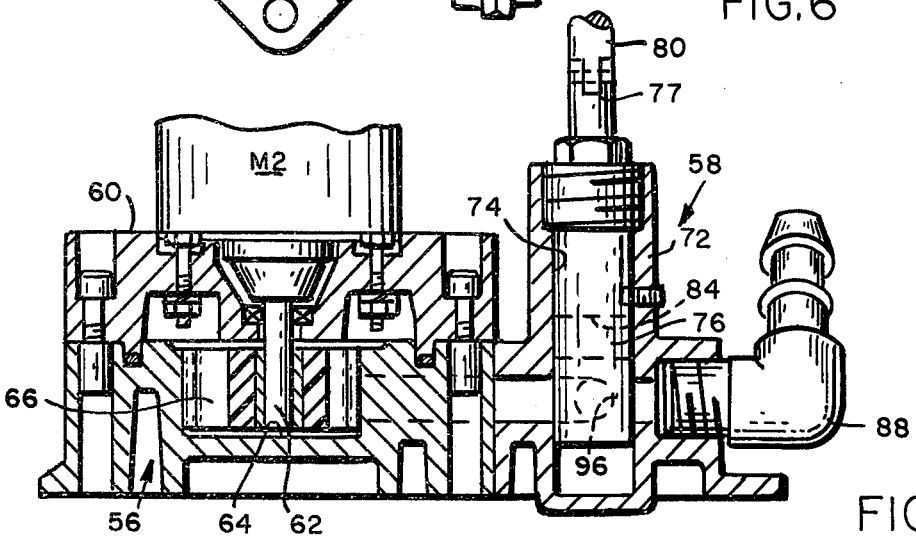
FIG. 7 is a section taken on the line 7—7 of FIG. 6.
Figure 2:
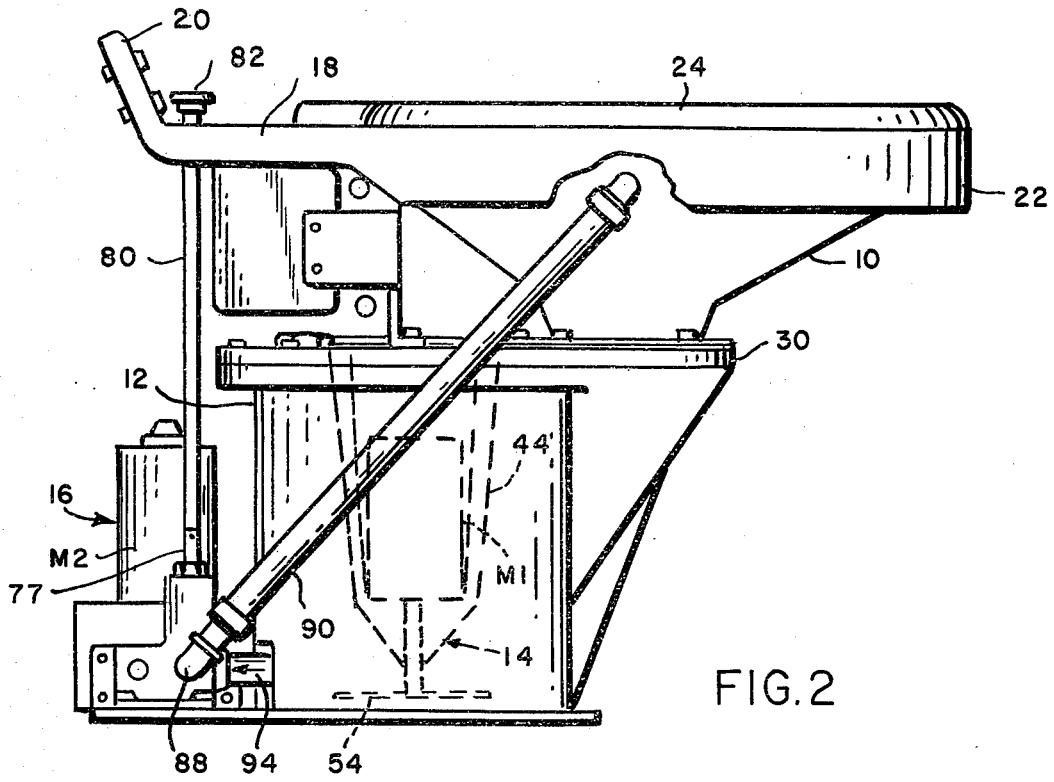
FIG. 2 is an elevation taken from the left-hand side of FIG. 1.
Figure 3:
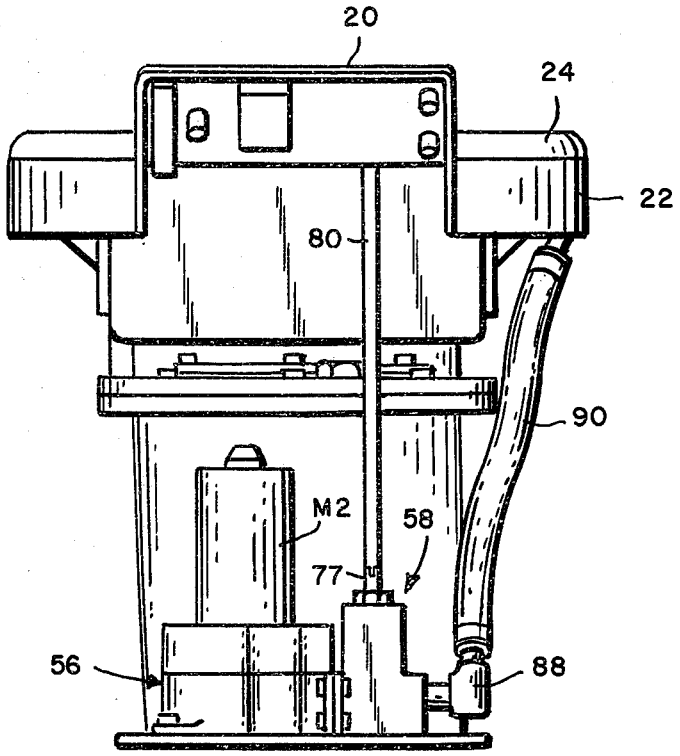
FIG. 3 is an elevation taken at the rear side of FIG. 1.
Figures 4, 5:
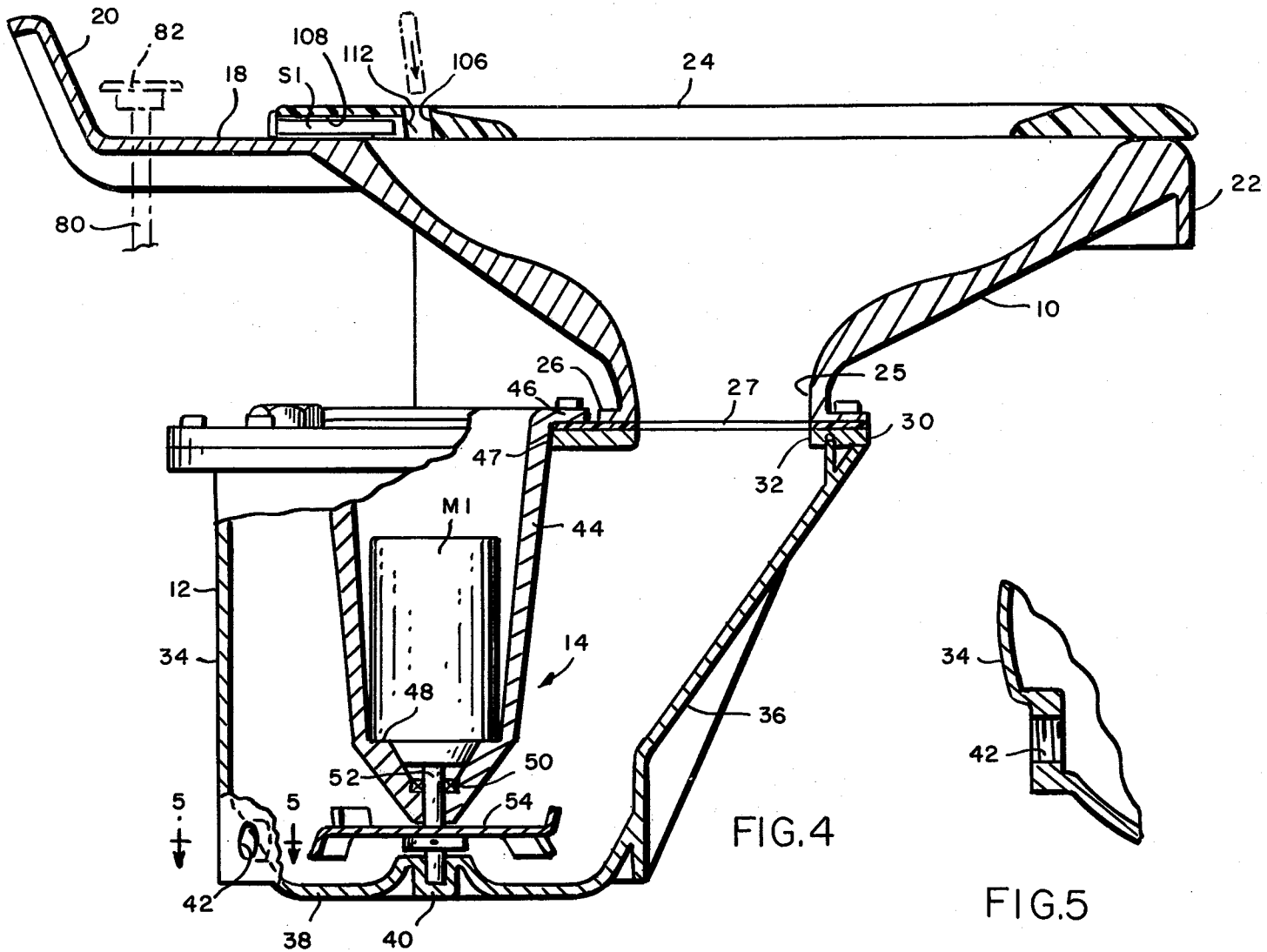
FIG. 4 is a vertical section taken on the line 4—4 of FIG. 1.
FIG. 5 is a fragmentary section taken on the line 5—5 of FIG. 4.

Referring to FIGS. 2 and 4, the toilet as herein illustrated comprises essentially a bowl 10, a treating chamber 12 containing a macerator 14 and a combination pump and valve assembly 16, FIGS. 6 and 7, connected by suitable plumbing to the bowl and to the treating chamber in such a way as to enable delivering flush water to the bowl for flushing the effluent therefrom into the treating chamber and, after maceration has been accomplished, discharging the effluent from the system.

Figure 1:
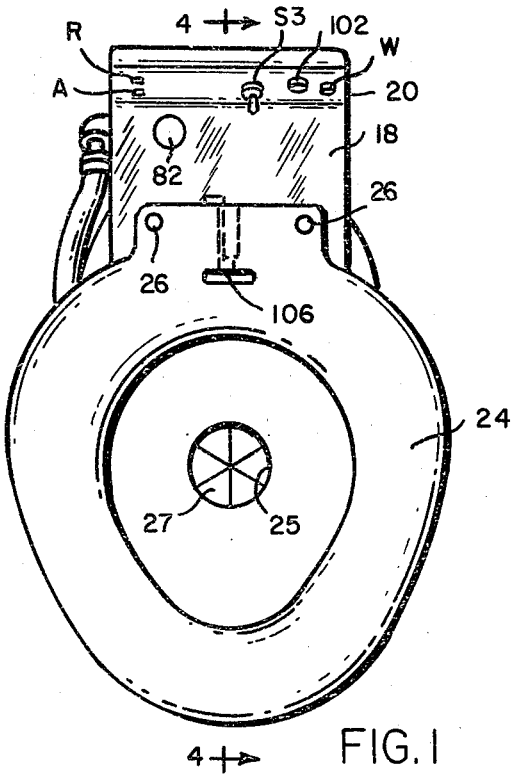
FIG. 1 is a plan view of the toilet structure.

The bowl 10 as shown in FIGS. 1 and 4 is of generally oval cross section and is provided at its rear end with an integral extension 18 and an upwardly inclined control panel 20 upon which are mounted switch means and indicators which enable conveniently initiating the flushing operation and/or the cleaning operation and of determining at any time the condition of the apparatus. The upper or rim of the bowl 10 is provided with a downturned skirt 22 which extends all the way around and along the opposite sides of the extension and the panel to afford an attractive appearance. A seat 24 is mounted atop the bowl in conventional fashion and is provided for this purpose at its rear end with transversely spaced holes 26—26 for receiving hinge means for pivotally connecting the seat to the bowl. The lower end of the bowl, FIG. 4, has a centrally located opening 25 defined by an annular flange 26 which seats against a cover plate 30 at the top of the treating chamber 12. The plate 30 contains an opening 32 through which the effluent can be flushed into the treating chamber. A combination gasket and splash guard 27 is provided between the bowl and the treating chamber to provide a watertight joint and to prevent splash of the effluent during maceration upwardly into the bowl.

The treating chamber 12 is of generally cylindrical cross section at the lower part, having a side wall 34, FIG. 4, which is generally perpendicular to the bottom, except for one side, the forward side, which has an upwardly and forwardly divergent wall 36. The bottom wall 38 is of annular configuration and has at its center a step bearing 40. Near the bottom, at the side substantially opposite the forwardly divergent wall 36, there is a discharge port 42, FIGS. 4 and 5. The annular, hemitoroidal shape at the bottom is like that in application Ser. No. 610,097, filed Sept. 4, 1975, for "HYDRAULIC ATTRITION UNIT FOR MARINE TOILETS" and provides in conjunction with the macerator blade an especially effective means for beating paper stock into its constituent fibers.

The macerator 14 is mounted within the treating chamber 12 in a housing 44, FIG. 4, provided with a flange 46 at its top by means of which it is attached to the cover plate 30 within an opening 47. The housing 44 is of sufficient size to receive the macerator motor M1 and is provided in its lower part with a horizontal bottom part 48 to which the motor housing can be bolted. The lower part also contains a central bearing 50 for rotatably and sealably receiving the motor shaft 52, to the lower end of which is fixed the macerator blade 54. Desirably, the shaft 52 extends beyond the blade for engagement with the step bearing 40.

The macerator blade 54 is of the kind disclosed in the aforesaid pending application and as described therein is designed to effect maceration by causing impact of the particles of the effluent with each other rather than a shearing action such as is commonly used by others for effecting the communition of solid material. The specific reason for using a macerator of this kind rather than a shearing type of cutter is that the effluent contains a large proportion of paper which a shearing blade will not cut through and which requires repeated pounding and recirculation to break it down into its constituent fibers. A cutting blade merely collects the fibers and becomes choked with the fibers so that its efficiency and effectiveness is reduced to uselessness in a very short period of time.

The combination pump and control valve assembly 16, FIGS. 6 and 7, comprises, as shown, a motor-driven pump 56 and a selector valve 58. The motor-driven pump is mounted at the rear side of the treating chamber 12 and comprises a pump block 60 bolted to the supporting plate or foot plate of the toilet and a motor M2 superimposed upon the block and bolted thereto with its drive shaft 62 extending perpendicularly downwardly therefrom through suitable bearings into a pump chamber 64 in the block 60. An impeller 66 is keyed to the shaft 62 in the pump chamber 64. The pump chamber 64 contains two ports 68 and 70. The motor M2 is reversible so that by effecting rotation of the pump in one direction, the port 68 will be an intake port and the port 70 will be a discharge port and by effecting rotation of the pump in the opposite direction, the port 68 will be a discharge port and the port 70 an intake port.

The selector valve 58, FIG. 7, comprises a valve housing 72 containing a vertically arranged valve chamber 74 in which there is slidably mounted a valve spool 76, the upper end of which is connected to the lower end of a spindle 77 which extends through suitable packing 78. The protruding end of the spindle 77 is connected to the lower end of a plunger rod 80 which extends upwardly from the valve assembly through the horizontal extension 18 of the bowl so as to be located forwardly of the panel 20. A knob 20 at the upper end of the rod provides means which may be grasped to move it upwardly and downwardly. The valve spool contains ports 84 and 96. When the port 84 is brought into alignment with the port 70 and the pump is rotated in the proper direction, the water will be drawn into the system through the port 68 and delivered through a coupling 88 and conductor 90 into the bowl for flushing the latter. The valve housing 72 is provided with a port 92 which is connected by a pipe 94 to the port 42 in the treating chamber so that when the valve spool is moved to align the port 96 with the port 92 and the pump is reversed, the effluent will be withdrawn from the treating chamber and discharged.

Figure 8:
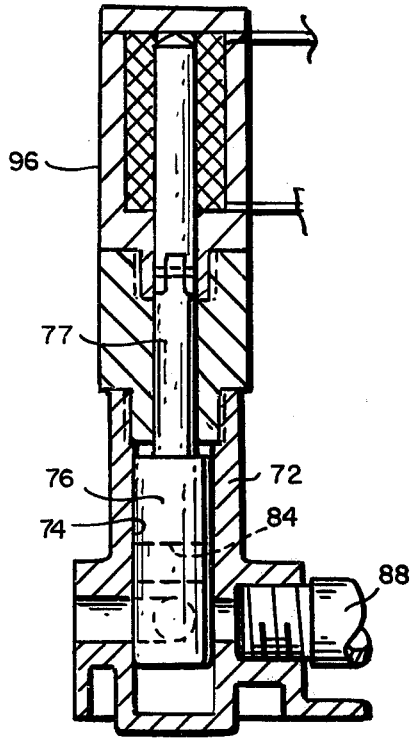
FIG. 8 is a section of a modified form of the valve assembly.

The selector valve 58 may, as stated above, be manually actuated by lifting and depressing the rod 80. However, as shown in FIG. 8, it may be automatically actuated by means of a solenoid SOL connected to the upper end of the spindle 77.

The system is controlled partly through manually operable switches and partly automatically as follows, FIGS. 9 and 10: referring to FIGS. 1, 9 and 10, there is mounted on the panel 18 a two-position toggle switch S3 which, in one position, effects flushing and, in the other position, discharge. Power is supplied to the system through a circuit breaker 102 and when the power is on, this fact is indicated by a white light W adjacent the circuit breaker. It is within the scope of the invention to automate the entire cycle of operation.

It is not only necessary to macerate the effluent, but also to effect decontamination and deodorization and, of course, the greater the amount of maceration and, hence, reduction in particle size, the greater is the effectiveness of the decontaminant and/or deodorizer. A combination decontaminant and/or deodorizer is introduced into the system in suitable form, for example, the form of a tablet directly into the bowl and, for this purpose, there is provided, as shown in FIG. 1, at the rear end of the toilet seat, a slot 106 through which the tablet may be dropped. At the underside of the seat adjacent the opening 106, FIG. 4, there is a recess 108 within which there is mounted a switch assembly S1 provided at its forward end with an actuator finger 112 which extends into the opening 106 and, when deflected by dropping the table through the slot 106, will complete a circuit through the switch to start the motor M1 of the macerator. Desirably, the switch-actuating finger 112 is set so that a predetermined force is required to effect its displacement and the tablets are made strong enough to effect such displacement so that a tablet not specifically made for this purpose will not actuate the switch and, hence, will not start the macerator.

Instead of the switch S1, a sensing device of well-known kind such as a magnetic switch, photocells, proximity switch, microswitch, reed switch or the like may be used operable by, or in response to, the size, shape, hardness, color or embossment of the bacteriacide. The bacteriacide itself may be a tablet, cartridge, capsule, powder or liquid.

It is within the scope of the invention to introduce the bacteriacide into the effluent prior to or after its maceration, for example, it may, as described above, be deposited in the bowl and flushed together with the effluent into the treating chamber, or it may be injected directly into the treating chamber, for example, by squirting a charge of bacteriacide directly into the treating chamber each time the bowl is flushed or the macerator is started. It is foreseen that a multiplicity of toilet systems such as described may be used in apartment-type dwelling units, might be connected by suitable plumbing to a common holding tank or discharge tank so that the macerated effluent from the entire building could be temporarily held where, for example, there is not an available sewage system, and where, for example, it is not desirable to have individual holding tanks for each unit. Such a system would eliminate the responsibility of the individual to introduce the bacteriacide into the toilet, shifting the obligation to the building manager or some other responsible person, thus making it a more foolproof system of disposal without accidental contamination through the carelessness of individual users. The effluent so collected may be recoverable as a liquid or solid, for example, by evaporation of the liquid for fertilization purposes.

A large proportion of the effluent, of course, is paper which is not valuable as a fertilizer and, furthermore, tends to clog plumbing. Hence, it is desirable to remove this bulk paper fiber from the treated effluent. This can be done by inserting a filter unit between the discharge side of the toilet system and the waste pipe leading to the holding tank or to the sewer system. Desirably, such a unit should be designed to be expendable so that when it becomes filled, it can be removed and replaced by a new filter.

The macerator is allowed to run for a predetermined length of time as determined by a timer T to effect complete decontamination and reduction of the effluent to a particle size which is acceptable and to a bacteria count which is acceptable. whereupon the switch S3 is changed over to the discharge position and, in this position, will start the motor M2 of the pump to rotate the pump in a direction to discharge the macerated effluent from the system. After having run the system through a cycle for the purpose of macerating the effluent and discharging it, the system can be cleaned of any residual effluent without reintroducing a chemical and without operation of the macerator by simply flipping the switch S3 first to the flush position and then to the discharge position to circulate fresh water through the system. This may be done two or three times so that the entire system is thoroughly cleaned and will contain no residual fluids which could result in a deposit when standing in the system and become a source of bacterial growth or unpleasant odor. Prior to depositing the chemical tablet, it is, of course, necessary to shift the selector valve 58 either mechanically or electronically to a depressed position to provide for taking water into the system and prior to discharge, that is, after the macerator has completed its function, the valve must be shifted by pulling the rod upwardly. At the right-hand side of the panel 18, FIG. 1, there is the white light W which indicates the power is on. At the left-hand side of the panel 18, FIG. 1, there are two lights, an amber light A in the control circuit indicating that the system is in use and a red light R indicating the treating chamber is filled and should be emptied.

Since urine is sterile and contains no solid matter, operation of the macerator is not required nor is it necessary to introduce a bacteriacide. The system may be flushed and discharged simply by flipping the switch S3 first to the flush and then to the discharge. If the toggle switch were flipped to the flush position for flushing solid effluent without also starting the macerator motor, the system would instantly become inoperative since the conductor pipes and ports of the pump and valve are so small in diameter that they would not pass the effluent, hence, no harm can come of actuating the toggle switch to effect discharge in the event the macerator has not been operated or has become inoperative. The conductor pipes and parts are, for this purpose, approximately 7/16 inches in diameter.

Figure 9:
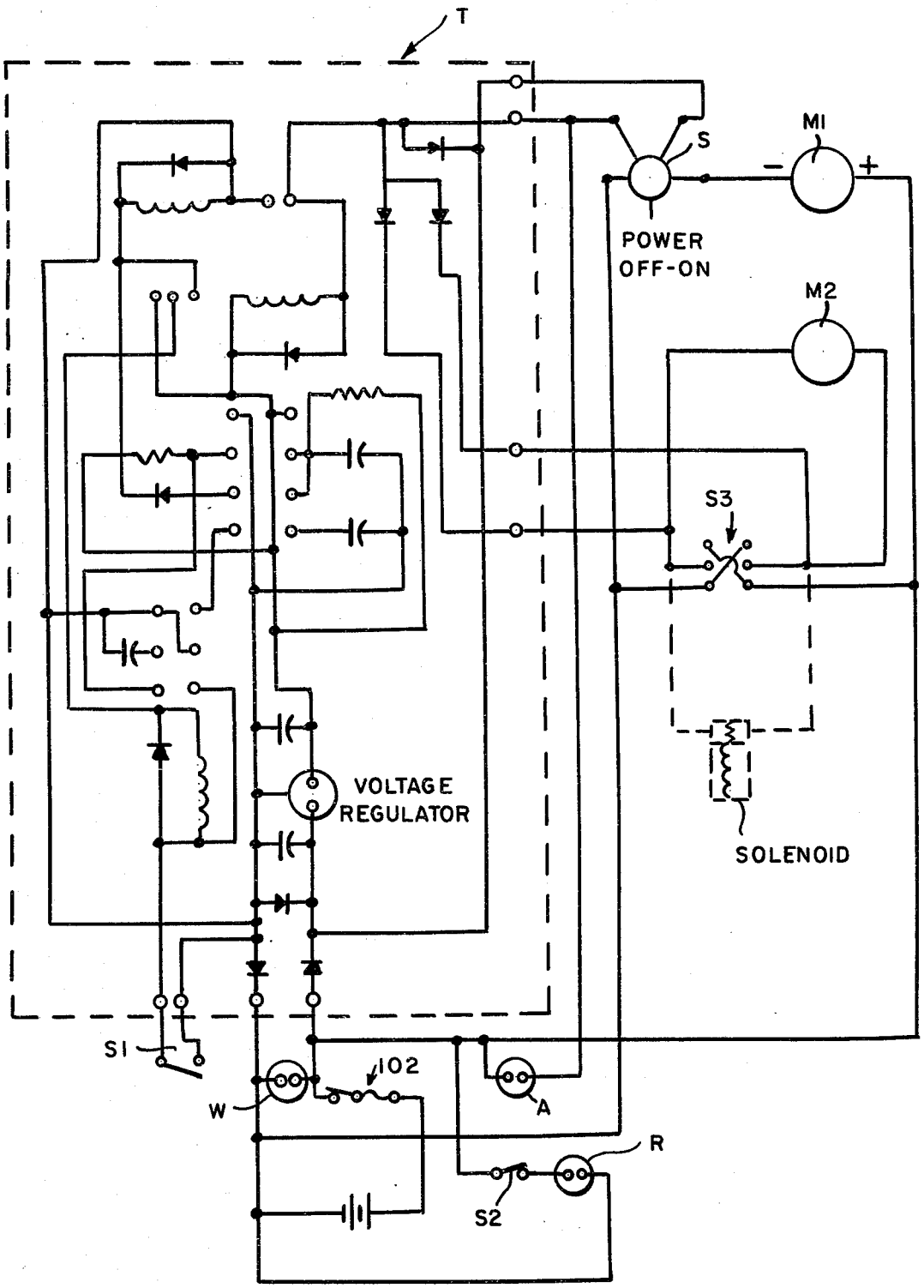
FIG. 9 is a wiring diagram of the control for operating the system.
Figure 10:
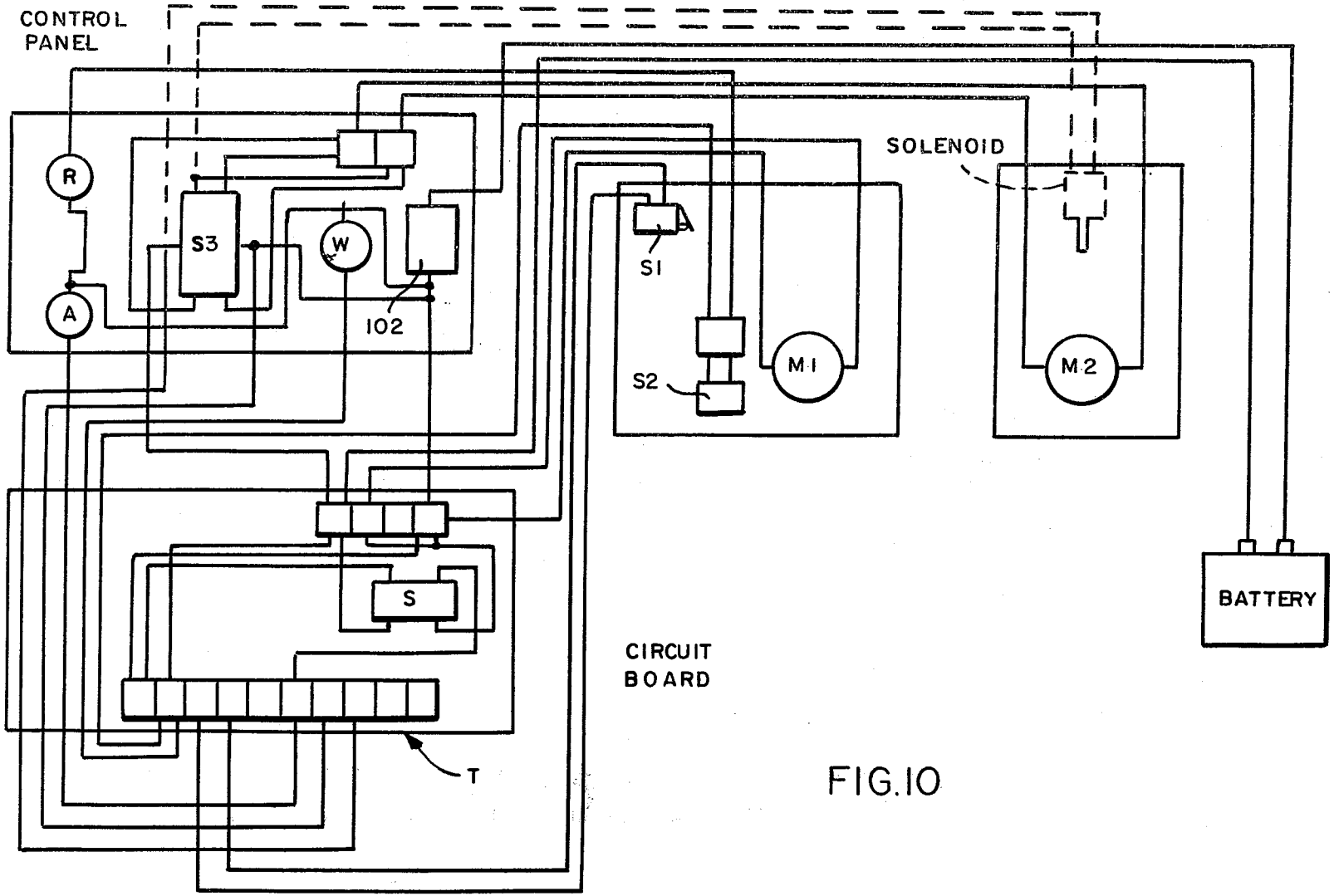
FIG. 10 is a block diagram of the control for operating the system.

The system is made ready for use by closing a master switch S as shown in FIGS. 9 and 10. Closing the switch S energizes the white light W to indicate that the power is on. In order to flush the toilet, the toggle switch S3 is moved to a position to start the pump motor M2 and held in this position until the bowl is completely flushed into the treating chamber, whereupon it is moved back to its neutral position and the pump motor M2 stopped. After flushing, a tablet is forced through the slot 106 and, as it passes through, it actuates the switch S1 which starts the macerator motor M1. A timer T in the macerator circuit is adapted to be set to continue operation of the macerator motor for a predetermined time and then to stop the macerator motor. When the macerator motor M1 stops, the amber light A goes on. Following maceration, the toggle switch S3 is moved to a position to start the pump motor M2 in the opposite direction and held in this position until the treating chamber is empty, whereupon it is released and the motor M2 will stop. The circuit as thus arranged enables purging the system without operating the macerator by the simple expedient of holding the toggle switch in the first position to charge flush water into the treating tank and then holding it in said second position to cause the water to be pumped out of the treating chamber. The valve 76 has to be moved in consonance with the pump motor to position it in a first position to admit flush water to the bowl for flushing and thereafter to a position to permit the effluent to be pumped out of the treating chamber when the switch is moved to the position to discharge the treating chamber. This may be effected by means of the push-pull rod 77,82 or by a solenoid 96, FIG. 8. Desirably, both the push-pull rod and solenoid are included in the system, the push-pull rod serving as a backup in the event that, for some reason, the solenoid fails to operate. There is a red light R on the panel which goes on when the treating chamber is filled to indicate to the user that the chamber should be emptied before reuse. A float-operated switch S2 serves to close the circuit to the red light when the effluent in the treating chamber reaches a predetermined level.

The system as described above is essentially of great simplicity as compared with most systems designed for the same purpose and is particularly attractive for the reason that its design frees the system from residual accumulations which may become the source of deposits within the system. This is provided by the reversible pump which is thus self-cleaning in operation and by employing a single selector valve through which the flush water reversibly flows. Efficiency in operation is achieved by disabling the macerator during the purging of the system. Further, as previously indicated, the macerator itself is especially effective in breaking up the solid material to a fineness to promote maximum decontamination and deodorization and the fact that the configuration of the macerating chamber and its isolation from the pump provides both ideal and maximum exposure of the effluent to the macerator.

It should be understood that the present disclosure is for the purpose of illustration only and includes all modifications or improvements which fall within the scope of the appended claims.

We claim:

1. A toilet system capable of rendering the effluent innocuous and reducing the solid matter therein to microparticle size comprising a bowl, a treating chamber connected to the bowl for receiving effluent from the bowl for treatment, a reversible, motor-driven pump, conductor means connecting the pump to the bowl and to the treating chamber, valve means interposed between the conductor means connecting the pump to the bowl and the conductor means connecting the pump to the treating chamber operable when the pump is rotated in one direction to take water into the system through a port and deliver it to the bowl to flush the latter and when the pump is rotated in the opposite direction to withdraw the effluent from the treating chamber and discharge it through the same port, macerator means in the treating chamber for macerating the effluent when flushed into the treating chamber and means for supplying a bacteriacide to the treating chamber.

2. A toilet system according to claim 1 wherein the bowl is connected to the top of the treating chamber by way of a splash guard, and the treating chamber is emptied through a port at the bottom thereof.

3. A toilet system according to claim 1 wherein the treating chamber is designed to contain the effluent in isolation during maceration and to be completely emptied following maceration.

4. A toilet system according to claim 1 wherein the bottom of the treating chamber is toroidal in vertical and diametral section.

5. A toilet system according to claim 1 wherein the macerator is motor-driven, there is means for receiving a tablet and conducting it into the bowl and a switch operable by receipt of the tablet to start the macerator motor.

6. A toilet system capable of rendering the effluent innocuous and reducing the solid matter therein to microparticle size comprising a bowl, a treating chamber connected to the bowl for receiving the effluent flushed from the bowl for treatment, a reversible, motor-driven pump, conductor means connecting the pump to the bowl and to the treating chamber, valve means interposed between the conductor means connecting the pump to the bowl and the conductor means connecting the pump to the treating chamber movable in one position to connect the pump to the bowl for supplying flush water to the bowl to flush the effluent into the treating chamber and to another position to connect the pump to the treating chamber for discharging the treated effluent from the treating chamber, means for effecting rotation of the motor-driven pump in a direction to take water into the system when the valve is in the one position and in a direction to discharge the treated effluent from the system when the valve is in the other position, a macerator in the treating chamber operable to effect maceration of the effluent therein and means for supplying a bacteriacide to the treating chamber so as to be present therein during the period of operation of the macerator.

7. A toilet system according to claim 6 wherein there is a switch for reversing the motor-driven pump and means for shifting the valve.

8. A toilet system according to claim 6 wherein a bacteriacide is used to render the effluent innocuous during the maceration thereof and there is means operable by deposit of the bacteriacide in the bowl to automatically start the macerator.

9. A toilet system according to claim 8 wherein the treating chamber is of a predetermined capacity such as to receive a predetermined volume of effluent for maceration in isolation and wherein the motor-driven pump is designed to discharge the entire amount of the treated effluent from the treating chamber.

10. A toilet system according to claim 9 wherein there is means for terminating the treating cycle within a predetermined time.

11. A toilet system according to claim 6 wherein there is a double-acting switch operable in one position to effect rotation of the motor-driven pump in the direction to take in flush water for cleaning the bowl and in the other position to discharge the cleaning water from the treating chamber without concurrent operation of the macerator.

12. A toilet system according to claim 6 wherein there is a slot for receiving and guiding a tablet into the bowl and a switch for initiating operation of the macerator provided with an actuating arm located in a position such that a tablet passing through the slot will actuate the switch and thus initiate operation of the macerator.

13. A toilet system comprising a bowl, a treating chamber connected to the bowl for receiving effluent flushed from the bowl for treatment, a motor-driven macerator in the treating chamber, a reversible, motor-driven pump, conductor means connecting the pump to the bowl and to the treating chamber, a two-position selector valve interposed in the conductor means connecting the pump to the bowl and the conductor means connecting the pump to the treating chamber, movable to one position to cause the pump in one direction of rotation to take water into the system and deliver it to the bowl to effect flushing and in the other position to cause the motor in the other direction of rotation to empty the treating chamber and discharge the effluent from the system, and a control circuit including a toggle switch operable in one position to actuate the pump motor to rotate it in one direction and in the other in the opposite direction, a solenoid connected to the two-position valve operable by actuation of the toggle switch to move it to the appropriate position for the direction of rotation of the pump motor, a switch actuatable upon entry of a bacteriacide into the treating chamber to start the macerator pump and a timer in the control circuit for terminating operation of the macerator pump following a predetermined interval.

14. A toilet system according to claim 13 wherein there is an ON-OFF switch for supplying power to the control circuit.

15. A toilet system according to claim 13 wherein there is an indicator light which becomes illuminated when the ON-OFF switch is on, indicating that the power is on.

16. A toilet system according to claim 13 wherein there is an IN-USE light operable when the macerator pump is in operation to indicate that the system is in use.

17. A toilet system according to claim 13 wherein there is a FULL light operable when the level of the effluent in the treating chamber reaches a predetermined level.

18. A toilet system according to claim 13 wherein the pump is ported with 7/16 inch intake and discharge ports such as to completely block passage of any unmacerated solid matter.

19. A toilet system capable of rendering the effluent innocuous and reducing the solid matter therein to microparticle size comprising a bowl, a treating chamber connected to the bowl for receiving effluent flushed from the bowl for treatment, a reversible, motor-driven pump, conductor means connecting the pump to the bowl and to the treating chamber, a two-position valve interposed between the conductor means connecting the pump to the bowl and the conductor means connecting the pump to the treating chamber operable in one position to cause the pump in one direction of operation to flush the bowl and in the other direction of operation to effect discharge of the treating chamber and a macerator in the treating chamber for macerating the content thereof.

20. A toilet system comprising a bowl, a treating chamber connected to the bowl for receiving effluent from the bowl, a macerator in the treating chamber, a reversible, motor-driven pump, conductor means connecting the pump to the bowl and to the treating chamber, a two-position selector valve interposed between the conductor means connecting the pump to the bowl and the conductor means connecting the pump to the treating chamber movable to one position to cause the pump in one direction of rotation to take water into the system and deliver it to the bowl to effect flushing and in the other position to cause the pump in the other direction of rotation to empty the treating chamber and discharge the effluent from the system, switch means for controlling the direction of rotation of the motor-driven pump and means for changing the position of the two-position valve.

* * * * *